United States Patent [19]

Lockyer

[11] 4,201,437

[45] May 6, 1980

[54] MOUNTING ARRANGEMENT FOR ELECTRICAL PLUG-IN COMPONENTS

[75] Inventor: John Lockyer, Smithtown, N.Y.

[73] Assignee: Deutsch Relays, Inc., Long Island, N.Y.

[21] Appl. No.: 911,891

[22] Filed: Jun. 2, 1978

[51] Int. Cl.[2] ..... H01R 13/60

[52] U.S. Cl. ..... 339/121; 339/126 R

[58] Field of Search ..... 339/126 R, 128, 121, 339/176 M, 125 R, 125 A, 125 L

[56] References Cited

U.S. PATENT DOCUMENTS

| | | | |
|---|---|---|---|
| 3,702,983 | 11/1972 | Chace | 339/121 X |
| 3,790,915 | 2/1974 | Dugan | 339/88 R |

*Primary Examiner*—Joseph H. McGlynn
*Assistant Examiner*—John S. Brown
*Attorney, Agent, or Firm*—Gausewitz, Carr & Rothenberg

[57] ABSTRACT

An arrangement for supporting electrical plug-in components which includes a mounting member defining an opening through which extend opposed flexible walls of a retaining unit having a bottom portion which carries one component to be secured, the component engaging the undersurface of the mounting member while shoulders formed on the edges of the retaining unit engage holding fingers extending into the opening of the mounting member. Locking clips are inserted between the electrical component and the retaining unit to prevent withdrawal of the socket and retaining unit. A relay fits between opposed walls of the retaining unit on the other side of the mounting member and includes a pair of radially extending pins which latch the relay to the retaining unit and also extend into recesses in a post fixed to the top of the relay to hold a latch operating knob and the pins to the relay. The holding fingers of the opening are arranged to mount and guide a retaining assembly for a large relay and socket or two retaining assemblies for two smaller relays and sockets.

25 Claims, 8 Drawing Figures

FIG. 4.
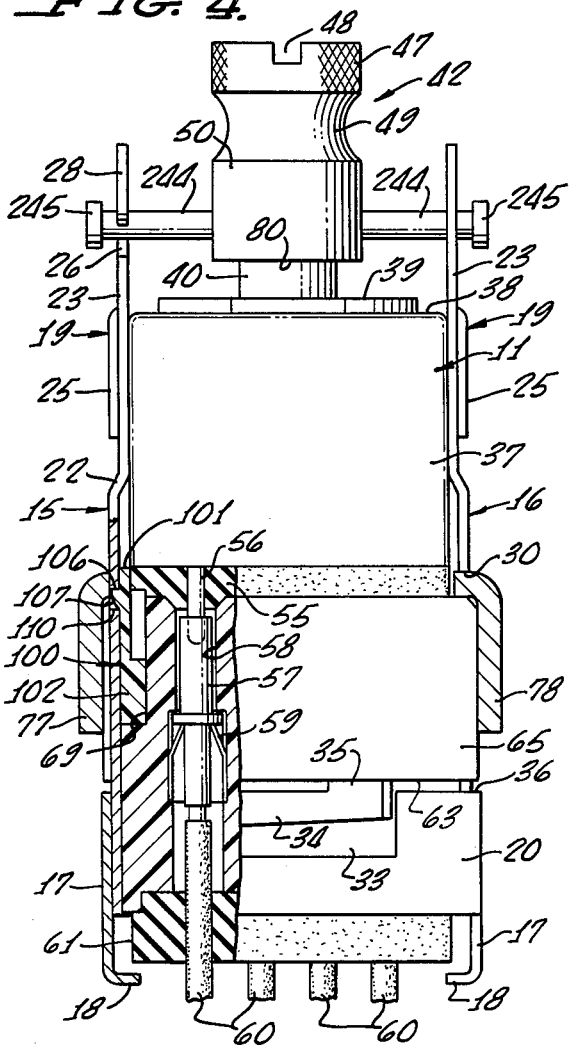
FIG. 5.
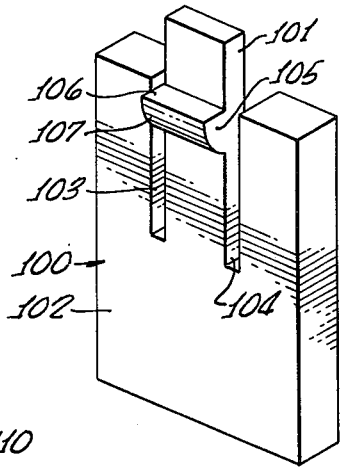
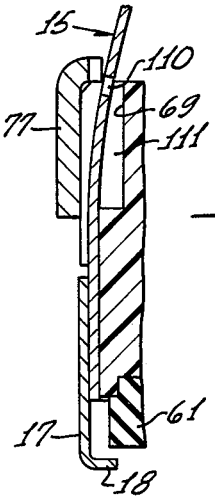
FIG. 6.
FIG. 7.
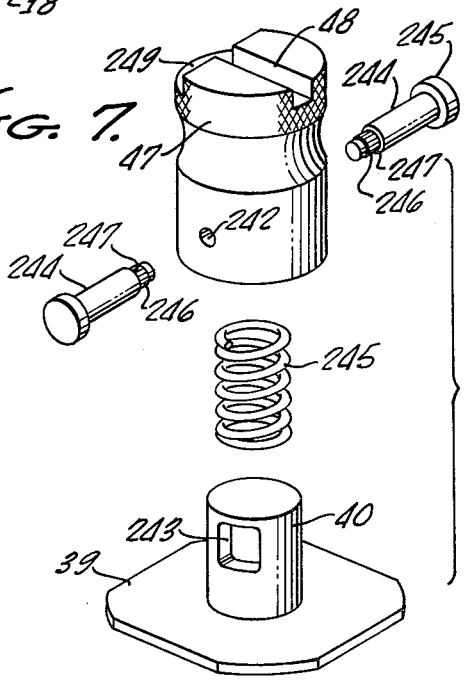
FIG. 8.
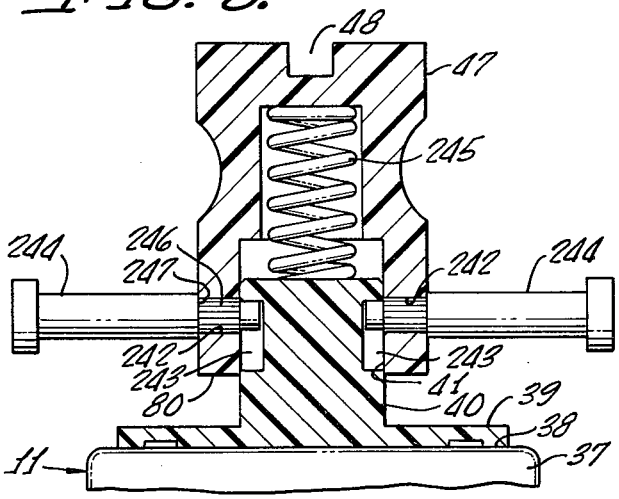

MOUNTING ARRANGEMENT FOR ELECTRICAL PLUG-IN COMPONENTS

BACKGROUND OF THE INVENTION

This invention relates to a mounting arrangement for electrical plug-in components such as relays and sockets and particularly comprises an improvement over the arrangement shown in U.S. Pat. No. 3,790,915 for Mounting Arrangement for Electrical Plug-In Components, assigned to the assignee of the present invention.

In aircraft and other locations it becomes necessary to mount a number of plug-in components, such as relays, on a support such as a chassis or track where they engage mating sockets. This has been accomplished through the use of studs and nuts. Several difficulties are encountered through the use of such mounting arrangements. Space is severely limited within an aircraft which restricts access to the securing means. Expensive special tools frequently are necessary to allow installation and removal of the relays. Even so, crowded spacing may prohibit individual relay removal. For field maintenance such special tools may not be available when removal and replacement become necessary. Working with tools within the limited space available can result in damage to the relays or sockets. This damage may be in the form of latent defects which do not become apparent until the aircraft is in service and which, therefore, can have serious consequences. Even under the best circumstances stud and nut connections for plug-in components are laborious and time-consuming, both for installation and disassembly. Threaded connections also are subject to possible loosening under vibrational loads and in some instances nuts may not be properly tightened when the installation is made.

U.S. Pat. No. 3,790,915 provides a mounting arrangement that eliminates many of these problems, but which itself suffers from certain disadvantages. Spring tabs extend outwardly of the attaching unit and these are subject to being distorted or bent during handling, thus preventing proper attachment. It has been found that the attaching unit may sometimes be removed together with its socket, after removing the relay and this is undesirable since in many applications it is only the relay that need be removed.

Since relays of different sizes are often employed, the prior arrangement requires openings in the mounting member dimensioned for different sized relays, or might allow shifting of a smaller component in a larger opening, whereas it would be preferable to provide openings that would accept and firmly locate various sizes of components. Moreover, in mounting certain types of relays it is possible to cock the relay so that it is connected electrically without securely mounting it physically in the retaining arrangement of the prior patent.

The locking knob on the relay of the prior patent is not sealed against adverse environmental conditions to a satisfactory degree and some relays can be inadvertently mounted in reversed position.

Accordingly, it is an object of the present invention to provide a mounting arrangement that minimizes or eliminates above-mentioned problems.

SUMMARY OF THE INVENTION

In carrying out principles of the present invention in accordance with a preferred embodiment thereof, a device for releasably retaining plug-in components in mated position comprises a first member having an opening with projecting holding fingers. A retainer assembly, which mounts a first electrical component adjacent one side of the opening, has retainer elements extending through the opening and includes a recess in at least one that receives a holding finger to prevent movement of the assembly in at least one direction relative to the first member. The retainer element is displaceable to shift the recess from the holding finger for insertion and withdrawal of the retainer assembly into and from the opening, and means on portions of the retainer elements remote from the first electrical component secure a second electrical component thereto in mating relation to the first electrical component.

The holding fingers are formed as a plurality of tabs fixed to the member and projecting inwardly in the plane of the opening at points spaced about the periphery thereof. The tabs are positioned so as to divide the opening in two, allowing either one full size retainer unit to be mounted in the openings to completely fill it, or alternatively, allowing two half-size retainer units to be mounted in the opening, collectively filling it. A locking clip is provided for insertion between a displaceable retainer element and the first electrical component to prevent removal of the retainer assembly from the mounting member. Another feature of the assembly is a flange on one of the retainer elements extending toward the other element to orient the removable electrical component and facilitate its physical attachment.

A further feature of the assembly comprises an improved post and knob arrangement in which the post has an outwardly facing recess therein and a knob, having a bore which slidably and rotationally mounts the knob on the post, is attached to the relay. A pin fixed to the knob extends radially therethrough into engagement with the post recess. This pin, which thus positions the knob on the post and limits the relative motion of the two, also cooperates with a bayonet slot on the retainer element to hold the relay in position. A polarized display is provided on the knob to provide a visual indication of both direction and sense of the mounting position of the relay, also indicating whether or not the relay is locked in position.

BRIEF DESCRIPTION OF THE DRAWINGS

FIG. 4 is a longitudinal sectional view of part of the arrangement of FIG. 2;

FIG. 5 is an enlarged perspective view of a locking clip;

FIG. 6 is a fragmentary view showing the flexible displacement of a retainer element with the locking clip removed;

FIG. 7 is an exploded perspective view of the relay knob and post arrangement; and FIG. 8 is a longitudinal sectional view of the post and knob of FIG. 7.

DETAILED DESCRIPTION

Figure 1:
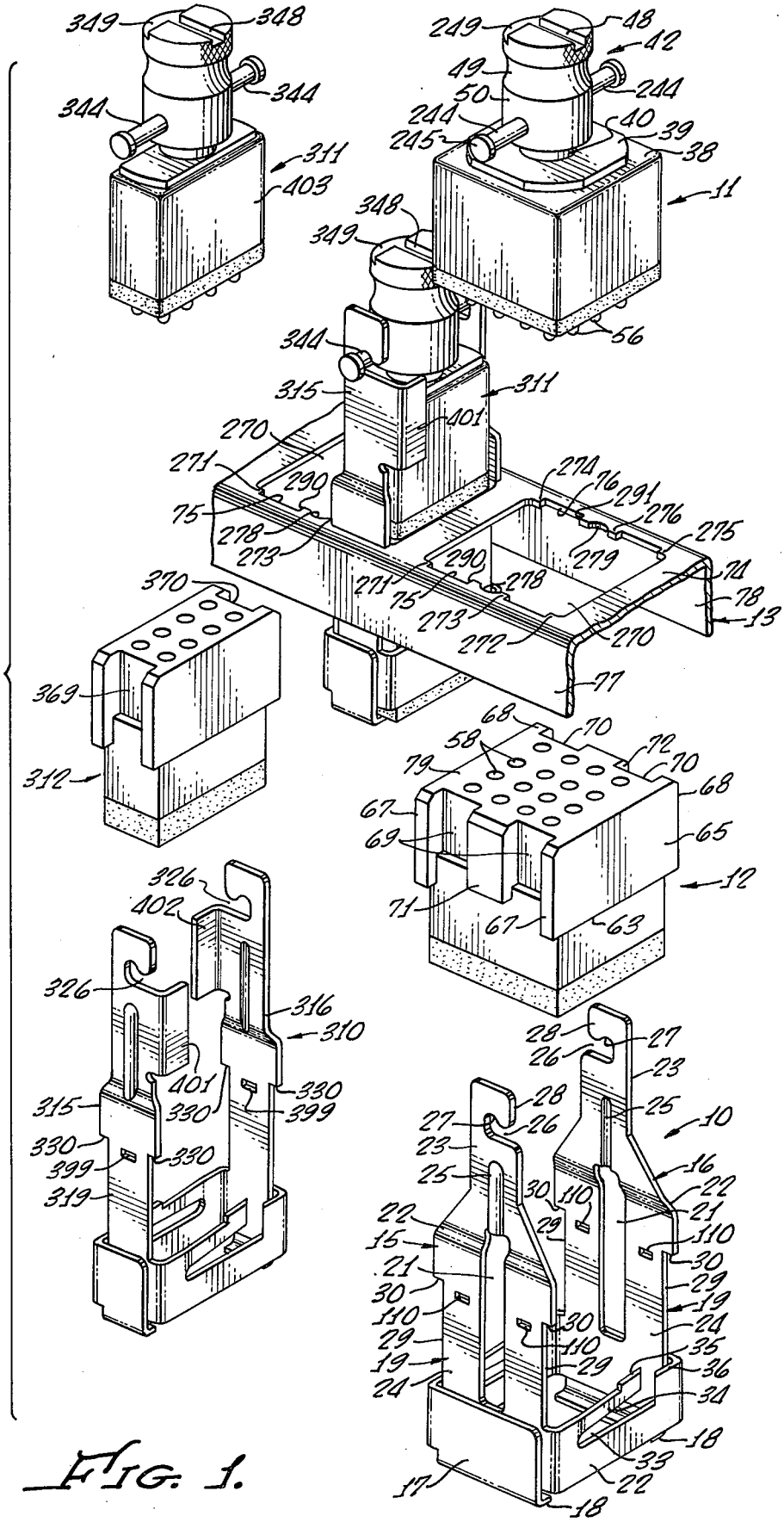
FIG. 1 is a perspective exploded view of an arrangement of parts embodying principles of the present invention.

The disclosed embodiment of the present invention includes an attachment assembly or retainer unit 10 which is used in securing a relatively large relay 11 and a mateable socket 12 in a mounting track 13. According to the present invention, the mounting track is formed to accommodate both large and small relays, and mateable large and small sockets, which are mounted by respective large and small retainer units. There will first be described the complete mounting arrangement of a relatively large retainer unit and a pair of relatively large electrical components, socket and relay, mounted thereto. Thereafter the manner of mounting one or two pairs of smaller electrical components in the same mounting hole or an identical mounting hole of the mounting member will be set forth.

Track 13 typically is mounted in an aircraft. Ordinarily a single track will mount a number of relays throughout its length, but for clarity there is illustrated only the mounting of one large relay and a pair of small relays.

Retainer unit 10 is made up of two identical resilient sheet metal retainer elements 15 and 16, each of which is U-shaped in plan. Each of these parts includes an end wall 17 having an inwardly bent flange 18 along its lower edge. The opposite wall 19 is connected to the wall 17 by an intermediate wall 20 which is perpendicular to the two walls 17 and 19. The wall 19 is much higher than the walls 17 and 20, extending well beyond the upper edges of the latter two walls. Intermediate the ends of the wall 19 is an elongated opening 21. A short laterally inwardly inclined section 22 causes the upper portion 23 of the wall 19 to be parallel to but positioned inwardly of the lower part 24 of the wall 19. Longitudinally of the upper section 23 is a reinforcing and guiding rib 25 for increased rigidity and guiding the assembly 10 into the hole in the mounting member as will be described below. A bayonet slot 26, having an inner recess 27, extends inwardly from the edge 28 of the upper section 23 which is adjacent the central member 20.

A lower section of each wall 19 is rebated on both edges, as at 29, to make such lower section of less width and to define a downwardly facing and outwardly projecting shoulder 30 on each edge of the wall. The narrower section of wall 19, together with the shoulder 30, in effect form a recess that is employed to lock the retainer assembly to the mounting member, as will be described below.

The intermediate wall 20 is provided with a cut-out 33 which results in a spring arm 34 along the upper part of wall 20. The distal end 35 of the spring arm 34 extends upwardly beyond the upper edges 36 of the remainder of the wall 20 and is inwardly bent.

Retainer elements 15 and 16 are spot welded together to provide a unitary assembly. The welds are accomplished where the wall 17 of the element 16 overlies the wall 19 of the element 15 and where the wall 17 of the element 15 extends over the wall 19 of the element 16. When so assembled, the lower part of the unit 10 defines a rectangular space bounded by the walls 19 and 20 with opposed flanges 18 extending inwardly at the bottom end. Bayonet slots 26 of retainer elements 15, 16 face in opposite directions at the upper end of the unit.

The operative parts of the relay 11 are contained within a housing or can 37 to the upper surface 38 of which is brazed a plate 39 from which a post 40 extends upwardly (see FIGS. 7 and 8). The post 40, which has a cylindrical exterior, is received within a complementary opening or bore 41 in a knob 42. Post 40 is formed with a pair of diametrically opposed outwardly facing and substantially rectangular recesses 243. Knob 42 has a related pair of radially extending and aligned apertures 242 receiving the ends of a pair of latch pins 244. Each pin has an enlarged head 245 on an outer end thereof and a reduced diameter inner end portion 246 that forms a shoulder 247 with the main shank of the pin. The reduced diameter end portion 246 is splined or grooved and is a press fit within the aperture 242 of the post, being locked therein by the splines and press fit. Shoulder 247 limits insertion of the pin into the knob aperture to the position illustrated in FIG. 8, wherein the innermost end of the pin seats within the recess 243 of the post. Since the recess is considerably larger than the end of the pin, the knob is mounted upon the post with a limited amount of freedom of axial and rotational motion, the limits being determined by engagement of the inner end of the pin with the walls of the post recess.

A compression spring 45 is received in the upper end of the knob bore 41, one end of the spring bearing against the knob 42 at the end of the bore 41 while the other end of the spring engages the end of the post. This biases the knob 42 to an upward position with respect to the post and hence relative to the relay 11.

The knob 42 includes an upper part 47 having a knurled circumferential surface and transverse slot 48. Transverse slot 48 terminates in a cross slot 249 to thereby provide a polarized display on the top of the knob. The polarized display indicates the orientation of the knob. The asymmetry or polarization of the display readily indicates whether the knob is pointed in one or the other of two directions that are 180 degrees apart (e.g., it indicates the sense of the orientation).

Beneath the upper part 47 of the knob is a section 49 of reduced diameter while the lower portion 50 has the same diameter as the upper part 47. Thus the knob can conveniently be gripped and moved rotationally or axially by virture of the narrow exterior surface at the upper portion and the reduced diameter at the portion 49.

At the lower surface of the relay 11 is a resilient rubber gasket 55 through which extend electrical pin contacts 56. These contacts are adapted to enter socket contacts 57 held within openings 58 in the socket 12 by suitable means such as retention clips 59. Wires 60 extend through openings in a sealing grommet 61 to engage the contacts 57. Consequently, in the assembled position, the wires 60 through the contracts 57 are electrically connected to the pins 56 of the relay 11.

The upper portion of the socket 12 is wider than the lower, resulting in a downwardly facing shoulder 62 and 63 along the two opposite sides 64 and 65 of the socket. When the socket 12 is positioned in the attaching unit 10, the shoulders 62 and 63 engage the ends 35 of the spring arms 34 formed on the walls 20 of the unit 10. Accordingly, the socket 12 is supported by the spring arms 34. In addition, the lower surface of the grommet 61 overlaps the flanges 18 at the bottom edges of the wall 17 so that there is a positive retention of the socket.

At the upper part of the socket 12 is a pair of short parallel flanges 67 projecting outwardly from one end of the socket, with similar flanges 68 projecting outwardly from the opposite end. The outer surfaces of the flanges 67 and 68 are flush with and form continuations of the upper parts of the opposite sides 64 and 65 of the socket 12. Between the flanges 67, the end surface 69 of the socket is recessed, and, intermediate the flanges 68, the end wall 70 of the socket 12 is similarly recessed. The central upper end wall portions 71 and 72, however, are not recessed, extending outwardly the same distance as the flanges 67 and 68.

When the socket 12 is assembled with the retainer unit 10, the walls 19 are received between the flanges 67 and 68, these flanges project outwardly beyond the plane of the lower portion 24 of the wall 19. The walls 19 are spaced outwardly of the rebated surfaces 69, 70, providing a space therebetween to permit the flexible walls 19 to be displaced inwardly toward each other and toward the socket surfaces 69, 70. The intermediate upper end portions 71 and 72 fit in the openings 21 of the walls 19.

Mounting track 13 is formed with a substantially rectangular opening 270 and a plurality of holding fingers 271 through 276 are fixed to the track and extend a short distance into the opening. Conveniently the holding fingers are integral with the web 74 of the track which has depending flanges 77, 78 to provide a generally C-shaped or channel section mounting member. Four holding fingers or tabs 271, 272, 274, 275 are located one at each corner and two intermediate tabs 273, 276 are positioned centrally between opposite pairs of adjacent corners of the opening and are provided with mutually facing arcuately recessed guide portions 278, 279.

Retainer unit 10 is connected to the track 13 with the socket 12 in place by moving it upwardly through the rectangular opening 270 in the upper wall 74 of the track. The upper portions 23 of the walls 19 are closer together than the spacing between the side edges 75 and 76 of the opening 270 which facilitates entry of the unit 10 into the opening in the track. As the retainer unit is moved upwardly through the opening 270, the retainer elements 15 and 16 are pressed together, moving the walls 19 inwardly, such movement being permitted because of the recessed configuration of the adjacent walls 69 and 70 of the socket 12. The openings 21 in lower portions 24 of walls 19 enhance the flexibility of these parts of the walls 19 and facilitate movement of the unit 10 into the opening 270. Further, the reinforcing and guiding ribs 25, upon initial entry of the retainer unit into the opening, are received in and guided by the respective arcuate guiding recesses 278, 279 of holding fingers 273, 276, and thus facilitate initial positioning of the unit within the opening.

Walls 19 are held in the inwardly displaced position during insertion of the retainer assembly into the track opening until the upper surface 79 of the socket engages the bottom surface of the wall or web 74 of the track member. At this time the recesses or shoulders 30 of retainer elements 15, 16 are above the upper surface of the track wall 74 and walls 19 then may be released from their inwardly displaced position whereupon they resiliently snap outwardly to cause the shoulders to engage in overlapping relation with the holding fingers 271, 272, 274 and 275. Opening 21 in the walls 19 receives and straddles the intermediate tabs 273 and 276 with the sides of the opening 21 abutting the outer edges of each of these tabs to thereby enhance the positioning of the retainer unit within the opening.

The outer edges of the socket flanges 67 and 68, as well as the central end wall portions 71 and 72, are spaced apart substantially the same distance as that between the parallel depending rails 77 and 78 of the track 13. Consequently, when the retainer unit is moved upwardly into position, the flanges 67 and 68 and the end wall portions 71 and 72 fit snugly between the rails 77 and 78 and position the socket firmly against lateral movement.

The outer edges of the flanges 67 and 68 and the upper central end wall portions 71 and 72 also fit beneath the wall 74 of the track 13 outwardly of the side edges 75, 76 of opening 270. This prevents upward movement of the socket 12 and hence the unit 10 relative to the track 13. Accordingly the flanges 67 and 68 and the end wall portions 71, 72 cooperate with the holding fingers 271, 272, 274 and 275 and shoulders 30 in holding the socket and the retainer unit against vertical movement, either upwardly or downwardly.

In this partially assembled condition, the retainer unit and socket can still be removed simply by inwardly displacing the retainer elements to disengage recesses 30 from the holding fingers and then withdrawing the unit from the track opening. In presently contemplated installations it is desired that the socket be permanently mounted to the track member even though the relay may be readily attached and removed. To this end there is provided additional locking means to prevent withdrawal of the socket and retainer unit once this subassembly has been installed as described above. Lock clips 100 (see FIGS. 4, 5) are provided in the form of elongated thin plates having a central upstanding resilient finger 101 struck from the main body portion 102 thereof by means of a pair of vertical slots 103, 104 extending only partly through the body from the upper end thereof. Finger 101 has a fixed laterally projecting dog 105 with a flat upper surface 106 and a curved lower surface 107. The spring finger 101 has a thickness less than the thickness of the body 102 of the lock clip, being coplanar with body 102 on the side from which dog 105 projects. This allows lateral motion of the finger 101 and dog 105 as the finger flexes to permit insertion of the cam dog 105 into an aperture or recess 110 formed in walls 19 of the retainer elements on either side of the opening 21. For each larger retainer unit 10, four lock clips are employed, two for each wall 19, with one on each side of opening 21.

With the retainer unit and socket assembled to the track member, but before the lock clips have been inserted, the walls 19 may be inwardly flexed toward the adjacent walls 69, 70 of the socket as illustrated in FIG. 6. This flexure allows the shoulders 30 to clear the holding fingers during insertion of the retainer unit. However, with the walls 19 in their outer (unflexed) positions and the shoulders engaged over and abutting the holding fingers of the opening, there is a space 111 between the mutually facing surfaces of the walls 19 and the walls 69, 70 of the socket 12. These walls 69, 70 are vertical, parallel to each other and parallel to the vertical extent of the retainer unit walls 19, and thus the space 111 is a substantially rectangular parallel wall space. Into this space, from the top of the track, is inserted the lock clip 100 with its finger 101 extending upwardly and with its dog 105 extending outwardly. As the clip is inserted downwardly into the space between the walls 19 and the socket walls 69, 70, the cam surface 107 of dog 105 causes the finger 101 to be cammed inwardly, toward the socket, permitting further insertion of the clip until the dog enters the aperture 110 in the wall 19. Preferably the aperture 110 is located at a position below the lower surface of the web 74 of track 13, with the retainer unit assembled to the track, to discourage removal of the lock clip which now can be removed only by being destroyed. With the lock clip inserted, walls 19 can no longer be inwardly displaced and thus the shoulders 30 cannot be disengaged from the holding fingers and withdrawal of the socket and retainer unit is prevented. The lock clips 100 not only prevent withdrawal of the unit 10, but also insure proper latching engagement of the shoulders 30 of the retainer elements with the holding fingers 271, 272, 274, 275 of the mounting track opening. Thus it is possible that if the retainer elements 15, 16 should become bent and thus permanently displaced inwardly so that even though the unit could be inserted into the opening, the fingers would not resiliently move outwardly to engage the shoulders over the fingers. The lock clips, when inserted into the space between the wall 19 and the walls 69, 70 of the socket, will force the retainer elements outwardly to thus insure proper latching engagement of the shoulders and fingers.

After the retainer unit and socket are attached and locked in place, the relay 11 is then attached to the socket 12, completing the assembly. This is accomplished merely by moving the relay downwardly between the walls 19 so that the depending contact pins 56 can enter the openings 58 to engage the socket contacts 57. In order for the relay to be moved downwardly in this manner, the knob 42 is rotated sufficiently to cause the bayonet pins 244 to pass by the edges 28 at the upper ends of the walls 19. When the relay is fully mated with the socket 12, the knob 42 is rotated back to position the pins 244 transversely relative to the relay, causing the pins to enter the bayonet slots 26. The compression spring 45 biases the knob 42 upwardly so that the pins are held in the inner recessed portions 27 of the bayonet slots 26 and the unit is fully secured in place. The reinforcing and guiding ribs 25 which have guided the retainer unit in the initial portion of its installation, help maintain the upper wall portions 23 in the proper position to permit entry of the pins 244 into the bayonet slots 26. Installation is rapidly and easily accomplished in this manner, entirely without tools, with the socket being securely and positively locked in place against removal.

There is a firm and positive locking of the entire unit, including the relay to the track. Nevertheless, disassembly of the relay is effected merely by pushing downwardly on the knob 42 and rotating it a few degrees to cause the pins 244 to leave the bayonet slots 26. The relay may then be pulled upwardly to disengage the socket and to become free of the attaching unit 10. The knob 42, positioned at the upper end of the assembly, is easily grasped and pulled to remove the relay even where the relay is closely crowded in with other elements.

The very same pins 244 that hold the entire relay assembly in the bayonet slots also hold the knob firmly to the relay and, in addition, limit the relative rotation and axial motion of the rod. Thus the arrangement of bayonet pins 244 and recesses 243 of the relay post 40 provides a simplified construction that performs a number of different functions and avoids the need for an opening in the knob wall, which could admit salt air, moisture, dust and the like.

Although the relay is readily removed and replaced, once the lock clips are inserted, neither the retainer unit nor the socket secured therein are removable.

A positive indication of whether or not the relay is properly engaged with the socket 12 is afforded by the cross slot 48 in the knob 42. The parts are proportioned such that the pins 244 cannot enter the bayonet slots 26 until the relay 11 is moved to its fully mated position with the socket 12. The bottom surface 80 of the knob 42 will engage the plate 39 on the relay 11 to stop the downward movement of the knob before the bayonet pins have reached the entrances to the bayonet slots 26 if the relay has not been shifted downwardly a sufficient distance to mate properly with the socket. With further downward movement of the knob 42 being blocked, the bayonet pins are prevented from entering the bayonet slots 26. Observing the slot 48 in the transverse position is an indication therefore that the relay is properly installed. Conversely, if the slot 48 is at an angle and not longitudinally of the track 13, it is known that the latch mechanism is not engaged and the relay is not properly installed. The position of the slot 48 is readily discerned because it is at the outer end of the unit where it is most readily seen. The bayonet pins 244 are also at the upper end and visible when the unit is inspected. In addition to being a position indicator, the slot 48 can be engaged by a screwdriver if it is desired to rotate the knob 42 in that manner.

In addition to indicating whether or not the bayonet slots or the pins 244 are engaged in the bayonet slots, it is necessary to indicate whether or not the relay has been installed in its proper position. In many relays, where the pin arrangement is not polarized but is relatively symmetrical, it is possible to install the relay in one of two different positions oriented at 180 degrees with respect to one another. In some cases a missing or damaged pin which normally would prevent installation of the relay in reverse position, may allow such improper installation, permitting a physical securement of the relay in a completely reversed position. Polarization of the slot 48, by means of the cross slot 249, provides a ready indication of whether or not the relay itself has been installed in reverse position. Thus, as can be seen from inspection of the several installed relays illustrated in FIG. 2, the common orientation of the directionally unique and unambiguous slots 48, 249 on the knob tops provides a quick verification of the fact that none of the relays has been reversed.

Since relays are made in different sizes and it is desirable in some installations to install a number of relays of different sizes in the same mounting member, the track opening 270 is formed to enable the mounting of either larger or smaller relays. The arrangement for mounting smaller relays is substantially identical to the arrangement for mounting the larger relays, with certain minor differences as will be described below. An attachment assembly or retainer unit 310 is used in securing a smaller relay 311 and an associated smaller socket 312 in one end of the opening 270 of the track 13. The relay 311, socket 312 and retainer unit 310 are all substantially identical in external configuration to the relay 11, socket 12 and retainer unit 10 of the larger assemblies (previously described) and identical or corresponding parts of the smaller units are designated by like reference numerals having the prefix 3. Thus, for example, smaller relay 311 corresponds to larger relay 11, and smaller retainer unit 310 corresponds to larger retainer unit 10.

Figure 2:
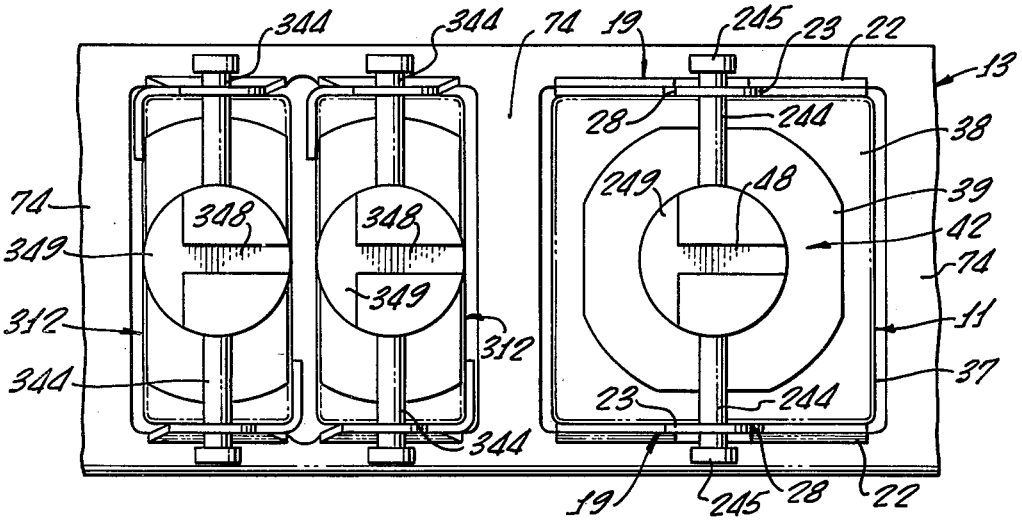
FIG. 2 is a top plan view of the components of FIG. 1 in assembled position.
Figure 3:
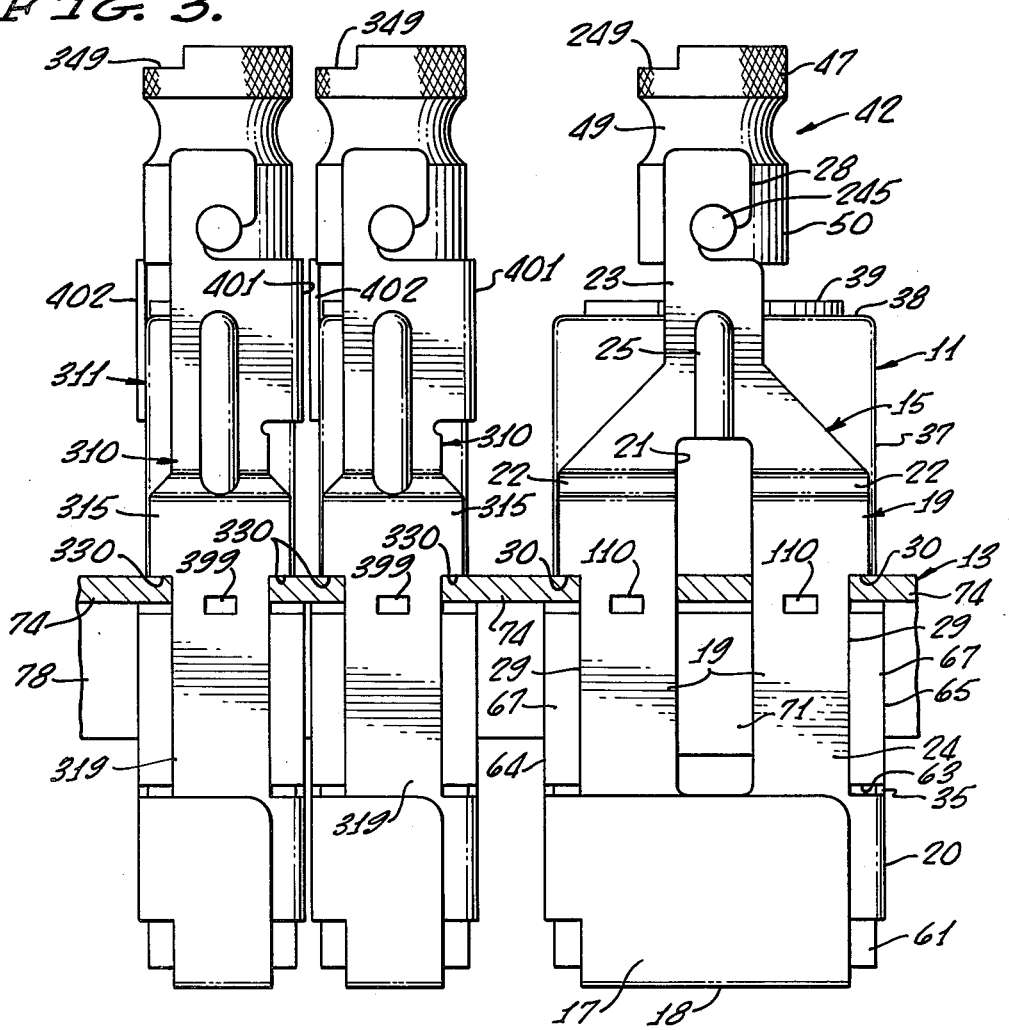
FIG. 3 is a side elevational view, partly in section, of parts of the arrangement of FIG. 2.

The dimensions of the smaller relay in a direction transverse to the extent of the mounting track 13 are the same as the dimensions of the larger relay, and similarly such dimensions of the socket and retainer unit in this direction are also the same as for the larger unit. However, the dimensions of the relatively smaller relay, socket and retainer unit in the direction of the length of the mounting track are slightly less than half that of the corresponding dimensions of the larger unit. This enables two of the smaller sets of mating relay and socket, together with their retainer units, to be mounted in a single opening in side-by-side relation as indicated in FIG. 2.

FIG. 1 shows a smaller relay unit and socket together with the smaller retainer unit completely assembled and mounted in one end of an opening of track 13 and a second set of relay, socket and retainer unit parts in exploded relation.

Construction of the retainer unit 310 is identical to construction of the retainer unit 10, except that the entire unit, as previously mentioned, is considerably smaller in the direction of the length of the track 13. Thus the walls 319 of retainer elements 315, 316 are considerably narrower and, as one significant difference, are not formed with an opening corresponding to opening 21 of the larger units. However, the walls 319 are formed with a narrower lower section rebated on both sides to provide a pair of recesses on element 315, recesses or shoulders 330 that cooperate with tab 271 and one edge 290 of the intermediate holding finger 273. A like pair of shoulders 330 on element 316 cooperate with finger 274 and one edge 291 of intermediate finger 276. Socket 312 is formed with centrally positioned rebated side walls 369, 370 which receive the narrow sections of retainer unit walls 319 and allow the inward flexing of these walls in order to engage shoulders 330 with the holding fingers of the mounting member opening. Similarly, an aperture 399 is formed in the narrowed section of wall 19 to receive the dog of a lock clip (not shown for the smaller relay assemblies) which is identical to and operates in the same manner as the lock clip illustrated in FIGS. 4, 5 and 6.

Socket 312 is retained in the lower portion of the retainer unit 310 just as the larger socket is retained in the larger unit 10. The unit is then inserted into the opening in a similar fashion. However, no initial guiding by the reinforcing and guiding ribs is provided for the smaller units. The two retainer elements 315 and 316 are inwardly displaced by pressing them toward each other and the unit is inserted at one end of the opening 270 with the narrow section of the walls 19 positioned between fingers 271, 274 and the facing edges 290, 291 of the intermediate finger 273. When the unit has been inserted far enough so that the shoulders 330 can overlie the upper surfaces of the fingers 271, 273, 274 and 276, the walls 319 are allowed to resiliently snap back to their outer positions in which the outer surfaces of the walls 319 abut the opening edges 75, 76, respectively. Now the shoulders 330 overlap and abut fingers 271, 273, and fingers 274, 276. Two lock clips (one for each element 315, 316) are inserted in the space between the inner surface of walls 319 and the rebated walls 369 and 370 of the socket 312 with the lock clip dogs entering recesses 399. Thus the socket and retainer unit are firmly and non-detachably secured to the mounting member 13.

It is found that at least in part because of the smaller dimension of the smaller relay, it is possible to insert the relay between the retainer elements 315 and 316 in a cocked position, a position in which the relay is somewhat rotated in a plane that is perpendicular to and bisects a line extending between the two retainer elements. Even with such a cocking, it is possible that electrical contact of the electrically conductive relay contact pins may be made with the socket contacts. Thus it is possible that the relay may be electrically connected but not adequately physically secured in position. To avoid this problem, the upper ends of retainer elements 315, 316 are formed with transversely extending flanges 401, 402 positioned just below bayonet slots 326 that receive pins 344 of the relay knob. Flanges 401 and 402 engage the side 403 and the opposite side (not shown in FIG. 1) of the smaller relay and insure proper orientation and physical securement between retainer elements 315, 316.

Thus it will be seen that only one opening configuration need be utilized in the mounting track to permit mounting two different sizes of relay and socket sets. The very same configuration that permits mounting of a large relay in an opening also permits mounting of either one or two small relays in an identical opening.

The greatly simplified and less vulnerable holding fingers, formed integrally with and extending in the plane of the opening, help to position the relays both laterally and longitudinally. In other words, not only do these holding fingers cooperate with the retainer unit shoulders to prevent withdrawal thereof, but also firmly position the unit and prevent motion thereof relative to the track in directions parallel to the surface of the track wall 74.

The combination of a corner holding finger, such as finger 271, and an intermediate holding finger, such as finger 273, firmly and accurately positions one of a pair of smaller relay/socket sets precisely at one end of the opening, and similar combinations of fingers will precisely position another set of such a pair at the other end of the same opening. The socket and retainer units are simply and firmly locked in place against withdrawal once they have been installed.

The improved relay mounting arrangement eliminates an opening in the knob of the prior patent which subjected the spring within the knob to adverse environmental conditions. It also employs the pins 244 to perform the functions of holding the relay to the retainer unit, holding the knob to the relay post, and also limiting the relative motion of knob and post.

Although the holding fingers are preferably positioned at the corners of the opening, and thus attached at two sides of the finger for increased strength, if desirable, such fingers can be displaced from the corners to cooperate with the apertures extending completely through the walls 19, or recesses formed in outer surfaces of the walls, instead of shoulders formed on the edges. If instead of using corner tabs as holding fingers, a plurality of fingers may be integrally formed, spaced along edges of the opening 270 about the periphery thereof, and projecting into the opening from opposite edges thereof. Corresponding apertures would then be formed in the walls 19 or 319 of large or small retainer units and thus retainer units of various sizes could be employed in the same aperture, provided only that the holding finger receiving apertures of the retainer elements are positioned to receive and latch upon the holding fingers as the retainer elements are inwardly displaced and then returned to outwardly displaced position.

The foregoing detailed description is to be clearly understood as given by way of illustration and example only, the spirit and scope of this invention being limited solely by the appended claims.

What is claimed is:

1. A device for releasably retaining a duality of plug-in components in a mated position comprising, a first member having a component mounting opening therein, said first member including means defining holding finger means projecting into said opening, a retainer assembly extending through said opening and having a first portion on one side of said opening, said assembly including means on said first portion for mounting a first electrical component adjacent one side of said opening, first and second retainer elements extending through said opening, at least one of said elements including means for defining a recess therein receiving said holding finger means and preventing movement of said assembly in at least one direction relative to said first member, at least said one element being displaceable to shift said recess from said holding finger means to allow insertion and withdrawal of said retainer assembly into and from said opening, said retainer assembly including means on portions of said retainer elements remote from said first portion for securing a second electrical component thereto in mating relation to said first electrical component.

2. The device of claim 1 wherein said holding finger means comprises a plurality of tabs fixed to said member and projecting inwardly in the plane of said opening at points spaced about the periphery thereof, said retainer elements each including a lateral edge adapted to be positioned adjacent a respective one of said tabs when the assembly is inserted into said opening, each said element having the side edge thereof formed with a reduced width portion defining a laterally facing recess that receives and abuts a respective one of said tabs.

3. The device of claim 1 wherein said opening is substantially rectangular and wherein said first member includes second holding finger means projecting inwardly of said opening in the plane of said opening and spaced from said first mentioned holding finger means along one edge of said opening by a distance less than the width of said opening, said retaining elements having a relatively narrow portion with edges abutting mutually facing sides of said first mentioned and second finger means and having a relatively wider portion defining a shoulder abutting surfaces of respective ones of said first mentioned and second finger means.

4. The device of claim 1 wherein said opening is substantially rectangular and including a second retainer assembly substantially similar to said first mentioned retainer assembly, said holding finger means comprising first and second fingers projecting into said opening at corners of a first pair of adjacent corners of said opening, a third holding finger projecting into said opening between said first and second fingers, fourth and fifth holding fingers projecting into said opening from corners of an opposite pair of corners of said opening, and a sixth holding finger projecting into said opening between said fourth and fifth fingers, said first mentioned retainer assembly being positioned at one end of said opening and having the retainer elements thereof abutting said first and fourth fingers and one edge of said third and sixth fingers, said second retainer assembly having third and fourth retainer elements extending through said opening, said third element having one edge recessed to receive said second finger and an opposite edge recessed to receive the opposite edge of said third finger, said fourth element having one edge recessed to receive said fifth finger and the other edge recessed to receive the opposite edge of said sixth finger, third and fourth electrical components, said second retainer assembly including means for securing said third electrical component in close proximity to and on one side of said first member and including means for securing said fourth electrical component on the other side of said first member in mating relation to said third electrical component, whereby two pairs of plug-in components are retained in mated position at a single opening.

5. The device of claim 4 wherein at least one of said retainer elements of each said assembly includes flange means extending toward the companion element for orienting one of said second and fourth electrical components and facilitating physical attachment thereof.

6. The device of claim 1 including means independent of said second electrical component for restraining displacement of said first element and thereby preventing said recess from being shifted from said finger means and preventing removal of said retainer assembly.

7. The device of claim 6 wherein said first element is spaced outwardly of a facing side of said first electrical component to permit said first element to be displaced inwardly toward said electrical component and to allow the retainer assembly to be moved into and out of said opening, said means for restraining displacement of said first element comprising a lock tab interposed between said first element and said facing side of said first electrical component.

8. The device of claim 7 wherein said first element includes means defining a recess on a surface thereof facing said one side of said first electrical component, and wherein said lock tab includes a laterally projecting dog received in said last mentioned recess whereby withdrawal of said lock tab is restrained by engagement of said dog and last mentioned recess.

9. The device of claim 1 wherein said holding finger means comprises a plurality of tabs integral with said first member and lying in the plane of said opening, and wherein said recess comprises a shoulder formed on a cut away edge of said one element.

10. A device for mounting electrical components comprising, a first member, first and second retainer elements secured to said first member and projecting therefrom in mutually spaced relation, said retainer elements having laterally opening slots in oppositely facing edges thereof, an electrical component positioned between said retainer elements, means for restraining motion of said component along said elements and away from said slots thereof, a post fixed to said component and having an outwardly facing recess therein, a knob having a bore slidably and rotationally receiving said post, means for urging said knob from said post, and a pin extending radially through said knob and fixed thereto, said pin having an inner end thereof received in said post recess, said recess being larger than said pin end whereby said knob and pin may be shifted rotationally and axially relative to said post through limited distances, said pin having an outer portion received within one of said laterally opening slots, whereby said knob and pin may be shifted axially of said post to allow said pin outer portion to enter and leave said one slot and may be rotated in said axially shifted position to cause said pin to enter or leave said one slot, said pin retaining said knob to said post, retaining said component to said one retainer element, and limiting axial and rotational motion of said knob and post.

11. The device of claim 10 wherein said electrical component can be mounted to and between said retaining elements in either of two positions angularly displaced from each other, and including direction indicating means associated with said component for providing a visual display of the angular position of said component with respect to said retaining elements.

12. The device of claim 11 wherein the angular difference between said two positions of said electrical component is considerably greater than the maximum rotation of said knob relative to said post and wherein said direction indicating means comprises a polarized display formed on said knob whereby said display will provide a visual indication of both direction and sense for the mounting position of said component and the rotational position of said knob relative to said post.

13. In combination with first and second electrical components, a device for mounting said electrical components comprising, a first member having an opening therein, a retainer assembly having first and second elongated resilient elements extending through said opening on opposite sides thereof, said elements including means for holding said first electrical component adjacent one side of said opening and including outwardly projecting means overlapping said first member adjacent the opposite side of said opening for holding the retainer against movement in one direction relative to said opening, said first electrical component having sides facing said retainer elements and spaced therefrom to permit movement of said elements toward said first component to disengage said overlapping means from said first member and permit insertion of said retainer assembly into said opening, and means interposed between one of said retainer elements and said first electrical component for restraining movement of said one retainer element toward said first component to prevent disengagement of said overlapping means, thereby preventing removal of said component and retainer assembly from said opening.

14. The device of claim 13 wherein said means for restraining movement comprises a lock tab inserted in the space between said one retainer element and said first electrical component, an aperture in said one retainer element, and a dog on said lock tab projecting into said aperture.

15. The device of claim 13 wherein said overlapping means comprises shoulders formed on opposite sides of said retainer elements and holding fingers projecting inwardly of said opening and engaging said shoulders at said one side of said first member.

16. The device of claim 15 wherein said retainer elements include portions extending beyond said one side of said first member and including means for securing said second electrical component thereto in mating engagement with said first electrical component, said retainer element portions including means for positioning said second electrical component relative to said retainer elements to limit lateral and rotational motion of said second electrical component in a plane that extends perpendicular to a line between said elements.

17. The device of claim 16 wherein said means for positioning said second electrical component comprises a first flange on one side of said portion of said element extending toward said other element and a second flange on the opposite edge of said portion of said second element extending toward said first element.

18. In combination with a mateable relay and socket, a mounting assembly comprising, a mounting track member having an opening therethrough, means on said track member defining a plurality of holding fingers extending into said opening, and a retainer unit comprising first and second mutually spaced retainer walls extending through said opening and projecting from opposite sides of said track member, means on said retainer walls for holding said socket against one side of said member at said opening, means defining a shoulder on each of said retainer walls bearing upon respective ones of said holding fingers on the other side of said member to prevent motion of said retainer unit and said socket in one direction from said opening, said retainer walls including portions on said other side of said track member and spaced therefrom for detachably securing said relay thereto at the other side of said member at said opening in mating engagement with said socket.

19. The mounting assembly of claim 18 including means independent of said relay for preventing disengagement of at least one of said shoulders from its holding finger to thereby prevent removal of said retainer assembly and socket from said track member even if said relay is not secured to said retainer wall portions.

20. The device of claim 19 wherein said retainer walls are spaced outwardly from adjacent sides of said socket and wherein said means for preventing disengagement of said shoulder comprises a locking clip inserted between one of said retainer walls and one side of said socket.

21. The device of claim 18 including first and second guide fingers on said track extending into said opening from opposite edges thereof, each said retainer wall having a centrally positioned longitudinally extending slot receiving one of said guide fingers.

22. The mounting assembly of claim 18 including first and second intermediate fingers on said track extending into said opening from opposite edges thereof and spaced from said holding fingers, each retainer wall having rebated edges abutting a holding finger and one edge of an adjacent intermediate finger to position the retainer unit laterally with respect to said opening, said retainer wall shoulders bearing upon surfaces of said holding fingers and intermediate fingers.

23. The mounting assembly of claim 18 including a clip interposed between at least one of said retainer walls and a facing side of said socket to space said wall from said socket side.

24. The device of claim 21 wherein each retainer wall has an outwardly facing guide rib, and wherein said guide fingers include means defining inwardly facing guide recesses for guiding said ribs during insertion of said unit into said opening.

25. In combination with first and second plug-in components, a device for releasably retaining said components in a mated position comprising, a first member having a component mounting opening therein, said first member including means defining holding finger means projecting into said opening, a retainer assembly extending through said opening and having a first portion on one side of said opening, said assembly including means on said first portion for mounting said first electrical component adjacent one side of said opening, first and second retainer elements extending through said opening, at least one of said elements including means for defining a recess therein receiving said holding finger means and preventing movement of said assembly in at least one direction relative to said first member, at least said one element being displaceable to shift said recess from said holding finger means to allow insertion and withdrawal of said retainer assembly into and from said opening, said retainer assembly including means on portions of said retainer elements remote from said first portion for securing said second electrical component thereto in mating relation to said first electrical component.

* * * * *